US005879540A

United States Patent [19]

Zinke et al.

[11] Patent Number: 5,879,540

[45] Date of Patent: Mar. 9, 1999

[54] PROCESS FOR REDUCING CORROSION IN A SYSTEM FOR SEPARATING AROMATIC HYDROCARBONS FROM A MIXTURE WITH ALIPHATIC HYDROCARBONS

[75] Inventors: Kevin Zinke, Alvin, Tex.; Dean Lagerwall, Amherst, N.Y.; Mohan Saran, Grand Island, N.Y.; David Albright, Niagara Falls, N.Y.; David Harrigan, Lewiston, N.Y.; Chandrasekhar Krishnan, Grand Island, N.Y.

[73] Assignee: Occidental Chemical Corporation, Niagara Falls, N.Y.

[21] Appl. No.: 898,012

[22] Filed: Jul. 25, 1997

[51] Int. Cl.[6] ..... C10G 21/28

[52] U.S. Cl. ..... 208/321; 208/322; 208/333; 208/339; 208/47; 585/864

[58] Field of Search ..... 208/321, 322, 208/339, 333, 47; 585/864

[56] References Cited

U.S. PATENT DOCUMENTS

| | | | |
|---|---|---|---|
| 2,878,182 | 3/1959 | Bloch | 208/321 |
| 3,492,222 | 1/1970 | Van Tassell | 208/321 |
| 3,864,245 | 2/1975 | Van Tassell | 208/321 |
| 3,883,420 | 5/1975 | Stone | 208/321 |
| 4,919,816 | 4/1990 | Tsao | 210/638 |
| 5,225,072 | 7/1993 | Vidueira | 208/321 |

*Primary Examiner*—Walter D. Griffin

*Attorney, Agent, or Firm*—Richard D. Fuerle; Anne E. Brookes

[57] ABSTRACT

Disclosed is a process for reducing corrosion in a system in which aromatic hydrocarbons are separated from a mixture with aliphatic hydrocarbons. The aromatic hydrocarbons are extracted from the mixture using an extracting solvent. The aromatic hydrocarbons are stripped from the extracting solvent with steam and the steam is condensed to form water which is separated from the aromatic hydrocarbons. The separated water is passed through a basic anion exchange column and is then heated to produce the steam.

22 Claims, 2 Drawing Sheets

$C_6 - C_8$
Aro + Ali
1
2
3
4
5
6
7
8
9
10
11
12
13
14
15
16
17
18
19
20
21
22
23
24
25
26
27
28
Aromatics + Glycol
Aliphatics
Ali Product
Aro Product
Aro
$H_2O$
$H_2O$ + Glycol
90% Glycol + 10%$H_2O$
90% Glycol + 10%$H_2O$
98+%$H_2O$
Aromatics + Steam
Aliphatics + Steam
Steam

PROCESS FOR REDUCING CORROSION IN A SYSTEM FOR SEPARATING AROMATIC HYDROCARBONS FROM A MIXTURE WITH ALIPHATIC HYDROCARBONS

BACKGROUND OF THE INVENTION

This invention relates to a process for reducing corrosion in a system in which aromatic hydrocarbons are separated from a mixture with aliphatic hydrocarbons. In particular, it relates to extracting the aromatic hydrocarbons from the mixture with an extracting solvent, stripping the extracted aromatic hydrocarbons from the extracting solvent with steam, condensing the steam to form water, separating the water from the aromatic hydrocarbons, passing the separated water through a basic anion exchange resin, and heating the water to produce the steam.

Cuts of cracked crude oil are mixtures of aromatic and aliphatic hydrocarbons. The aromatic hydrocarbons are used as solvents and chemical reactants while the aliphatic hydrocarbons are used as solvents or reactants and as olefin furnace feed. Separation of the aromatic hydrocarbons from the aliphatic hydrocarbons can be accomplished by extracting the aromatic hydrocarbons using an extracting solvent such as tetraethylene glycol. The aromatic hydrocarbons are then stripped from the extracting solvent with steam. The steam is condensed and the resulting water is separated from the aromatic hydrocarbons. To reduce pollution and maximize production, the water streams and extracting solvent streams are recycled. Gradually, these streams become more acidic due to the formation of acids, particularly acetic acid and formic acid, which corrode the system. Corrosion within the system acts as a catalyst for further acid formation, resulting in a non-linear accelerating rate of corrosion and the eventual destruction of the system.

To counteract this acidity, low concentrations (ppm) of caustic (an aqueous solution of NaOH) can be added to the extracting solvent. Caustic removes the acidity by forming water, but it also forms salts, such as sodium formate and sodium acetate. Furthermore, caustic and its salts can cause foaming in the system. The extracting solvent must then be separated from the salts by distillation. However, at the distillation temperature required to distill the extracting solvent (about 240° C. for tetraethylene glycol) some of the extracting solvent decomposes, resulting in a loss of extracting solvent over time and contamination of the system with the decomposition products. This in turn causes the extracting power of the solvent to gradually deteriorate.

Another method of reducing acidity in this system is suggested in U.S. Pat. No. 4,919,816, where some or all of the water used to wash the aromatic product is passed through an anion exchange resin.

Still another approach is disclosed in U.S. Pat. No. 2,878,182, where the extracting solvent is passed through an anion exchange column.

SUMMARY OF THE INVENTION

We have discovered that acidity in a system used for separating aromatic and aliphatic hydrocarbons can be reduced by passing the water used to strip the aromatic hydrocarbons through a basic anion exchange resin. By treating stripper water we are able to reduce the acidity from a range of about 30 to about 50 ppm down to less than 2 ppm. This results in a reduction in corrosion within the system of from 4 to 5 mils/year to less than about 0.7 mils/year.

The use of the basic anion exchange resin in the process of this invention eliminates the need for the addition of caustic to the extraction solvent, the need to distill the extraction solvent, and the loss of extraction solvent due to its decomposition during distillation.

DESCRIPTION OF THE PREFERRED EMBODIMENTS

Figure 1:
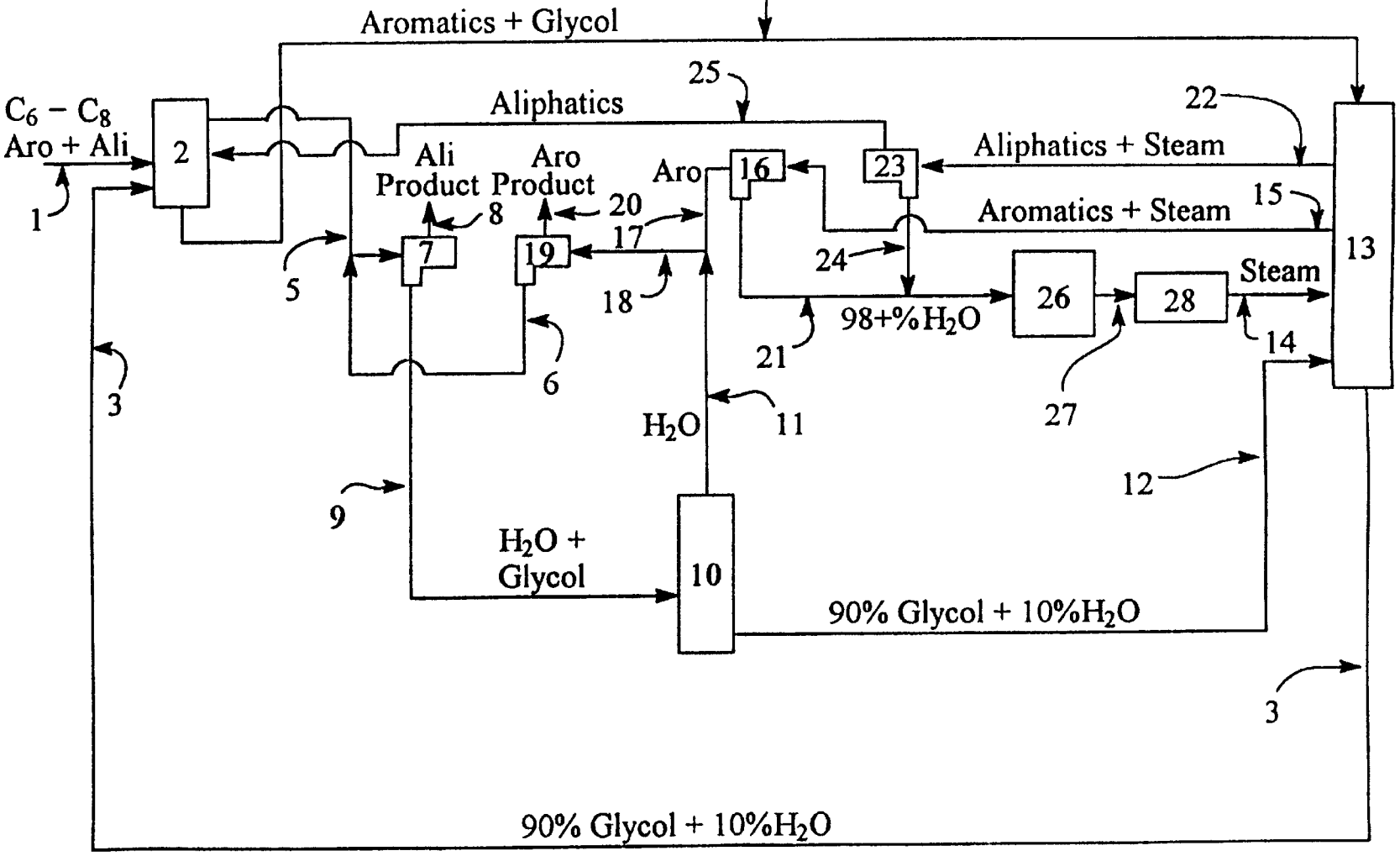
FIG. 1 is a diagrammatic block diagram illustrating a certain presently preferred embodiment of this invention.

In FIG. 1, a mixture of aromatic ("Aro") and aliphatic ("Ali") compounds, typically from a cut of cracked crude oil, in line 1, flows into extractor 2 where they are mixed with an extracting solvent (usually a glycol) from line 3. The aromatic compounds are extracted and leave the extractor through line 4. The raffinate (i.e., the aliphatic compounds) leaves extractor 2 through line 5. Those aliphatic compounds are washed with water from line 6 in tank 7 and leave tank 7 as the aliphatic product in line 8. The wash water leaves tank 7 through line 9 and enters distillation column 10, where it is separated into purer water in line 11 and mostly extracting solvent in line 12, which is sent to stripper 13.

Meanwhile, the aromatic compounds and extracting solvent in line 4 also enter stripper 13 where steam from line 14 strips the aromatic compounds from the extracting solvent. The aromatic compounds and the steam leave stripper 13 through line 15, then are condensed into water and an aromatic liquid and enter accumulator 16. In accumulator 16, the water separates from the aromatic compounds. The aromatic compounds leave accumulator 16 through line 17, are washed with water from line 11, pass through line 18 into tank 19, and leave tank 19 as the aromatic product in line 20. The water in accumulator 16 leaves accumulator 16 through line 21.

Any aliphatic compounds in stripper 13 leave with steam through line 22, then are condensed into water and an aliphatic liquid and enter accumulator 23 where the water separates from the aliphatic compounds. The water goes through line 24 to line 21 and the aliphatic compounds are returned to extractor 2 through line 25. Water in line 21 enters basic anion exchange column 26. This ion exchange column 26 is loaded with hydroxyl ions which are exchanged for acidic anions. The water leaves ion exchange column 26 through line 27 and enters heat exchanger 28. There it is converted to steam which enters stripper 13 through line 14.

There are two separate and independent water cycles in the process of this invention. In one cycle, the water circulates between stripper 13 and accumulators 16 and 23. The basic anion exchange column 26 is in that cycle. In a separate water cycle, water circulates between wash tanks 7 and 19 and distillation column 10. There is no ion exchange column in that cycle. Water in one of these cycles can enter the other cycle only to the extent that the glycol stream in line 12 contains water, such as a 90 wt % glycol-10 wt % water mixture. However, this is typically a very small stream, only 2000 to 2500 lbs/hr compared to the 1 to 1.2 million lbs/hr in line 3. It is, moreover, entirely feasible to send line 12 directly to line 3. (It is only for convenience and ease of handling that extracting solvent in line 12 is sent to stripper 13 instead of directly to extractor 2.)

This invention is applicable to processes in which mixtures of aromatic and aliphatic (including cycloaliphatic)

hydrocarbons are separated by extraction of the aromatic hydrocarbons and stripping the aromatic hydrocarbons from the extracting solvent. The hydrocarbons generally can have from 4 to 12 carbon atoms and preferably have 6 to 8 carbon atoms as hydrocarbons in that range are commercially more important.

The extracting solvent is any liquid that preferentially extracts aromatic hydrocarbons over aliphatic hydrocarbons. The boiling point of the extraction solvent should be higher than the boiling point of the aromatic hydrocarbons being extracted (i.e., it should have a boiling point of at least 100° C. and preferably between about 200° and about 300° C.) so that it is not evaporated during stripping. The extracting solvent should also be polar, miscible with the aromatic hydrocarbons, and stable in the separation process.

In order to further increase the selectivity of the extracting solvent, it is preferable to use an extracting solvent that comprises a mixture of an organic solvent and up to 25 wt % water. The amount of water in the extraction solvent is preferably about 8 to about 12 wt % as the best selectivity for aromatics is usually in that range. Examples of suitable organic solvents include acyclic and cyclic alcohols, glycols, glycol ethers, and glycol esters. Examples of suitable glycols include ethylene, propylene, and butylene glycols, such as ethylene glycol, diethylene glycol, triethylene glycol, tetraethylene glycol, propylene glycol, tripropylene glycol, and butylene glycol. Other suitable solvents include sulfolane, N-methylpyrrolidone, butyrolactone, phenol, dimethyl formamide, furfural, dimethyl sulfoxide, resorcinol, diethanolamine, and butylcarbitol. Tetraethylene glycol is preferred as it has better selectivity for aromatic hydrocarbons than any of the other solvents.

The anion exchange resin is preferably macroreticular (i.e., has large pores). It must be basic and is preferably a strong base anion exchange resin as those resins have higher operating capacities, which means that the resin must be regenerated less frequently. Examples of strong base resins include resins having quaternary ammonium with chloride anionic groups, which can readily be converted to hydroxyl active sites. Examples of weak base resins include resins having tertiary amines as an active group. The tertiary amine function may be, for example, the N,N-dimethyl amine group or the N,N-diethyl amine group. The backbones of the resins can be polystyrene, divinylbenzene, acrylic, or other polymers; a styrene-divinylbenzene backbone is preferred as it is readily available and works well. Preferably, enough anion exchange resin is used to last for one to six months.

The following example further illustrates this invention.

EXAMPLE

The process of this invention was tested in a pilot plant substantially as shown in FIG. 1. Ion exchange column 26 was a skid mounted stainless steel unit obtained from Ecolochem Inc. under the designation "Multiflow 500SS." The unit was packed with 56 cu. ft. of a Rohm & Haas strong base anion exchange resin having a quaternary ammonium group attached to a styrene-divinyl benzene backbone, sold as "IRA900." The internal volume of the unit was 90 cu. ft. to allow for a 50% expansion during resin backwash. The packed resin bed was about 3.5 ft. tall by about 5 ft. i.d.

Figure 2:
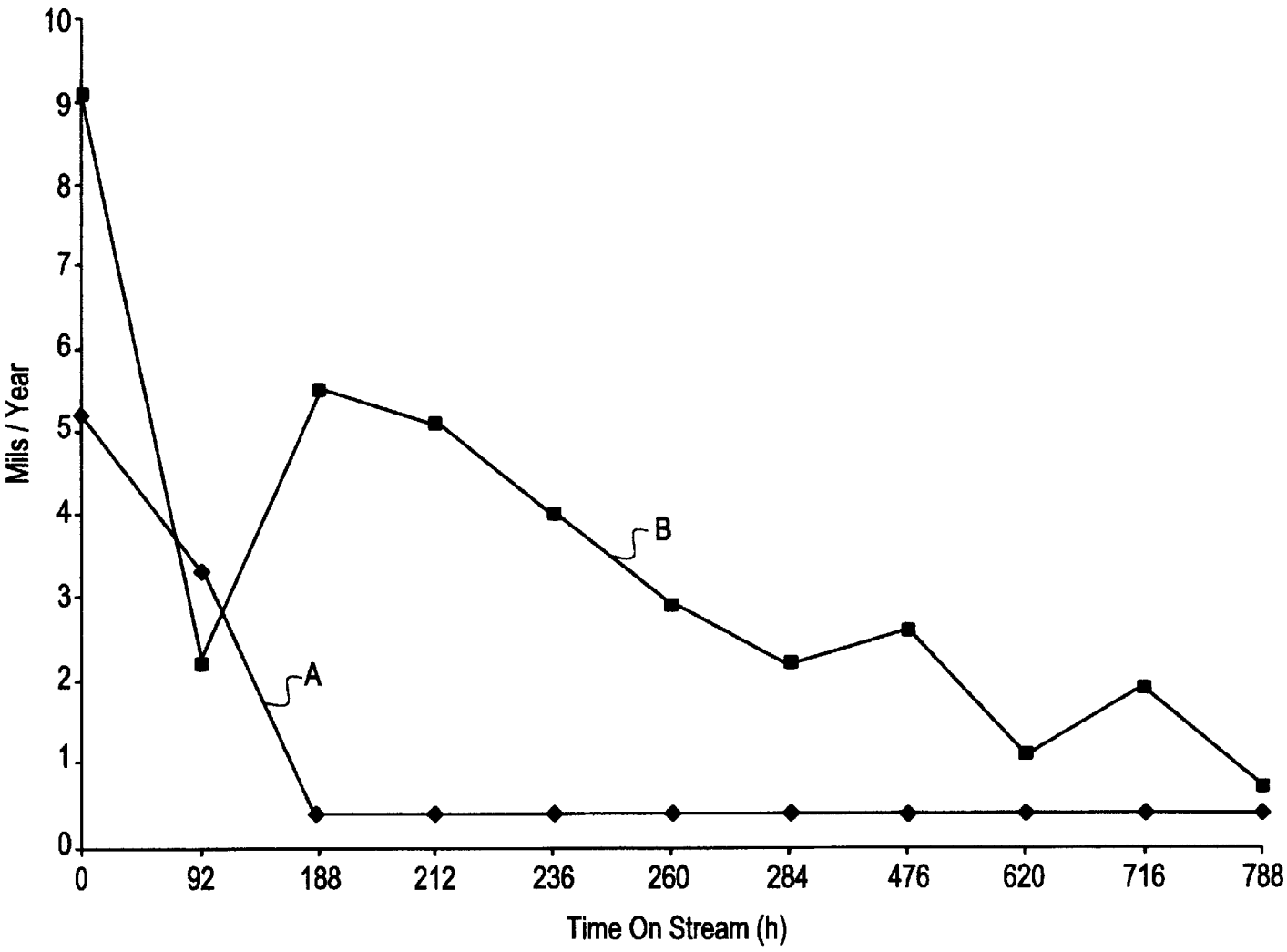
FIG. 2 is a graph of time versus corrosion, giving the results of a plant test of the process of this invention as described in the accompanying Example.

A full stream flow of 45,000 lb/h (about 90 gpm) of water in line 21 having an initial pH of about 5.5 to about 6 was treated. Two cartridge filters (10 micron size followed by a 1 micron size) were placed upstream of ion exchange unit 26 to prevent particulates from reaching the resin bed. The test was run continuously for 1 month. The corrosion rate in lines 18 and 9 (initially 4 to 5 mils/year) was periodically monitored. FIG. 2 gives the corrosion rate in lines 18 (A) and 9 (B) for the 788 hours of the test. The final corrosion rate in line 18 was 0.4 mils/yr and the final corrosion rate in line 9 was 0.7 mils/yr, which are considered to be acceptable commercial rates.

We claim:

1. A process for reducing corrosion in a system in which a mixture of $C_4$ to $C_{12}$ aromatic and aliphatic hydrocarbons are separated comprising (A) extracting said aromatic hydrocarbons from said mixture with an extracting solvent;

(B) stripping said extracted aromatic hydrocarbons from said extracting solvent with steam;

(C) condensing said steam to form water;

(D) separating said water from said aromatic hydrocarbons;

(E) passing all of said separated water from step (D) through a basic anion exchange resin;

(F) heating said separated water to produce said steam;

(G) washing said aromatic hydrocarbons with distilled water; and (H) recycling said distilled water from step (G) in a loop that includes a distillation step and recycling the water in steps (B), (C), (D), (E), and (F) in a separate and independent loop.

2. A process according to claim 1 wherein said basic anion exchange resin is a strong base resin.

3. A process according to claim 2 wherein said basic anion exchange resin is loaded with hydroxyl ions.

4. A process according to claim 1 wherein said basic anion exchange resin has tertiary amine active sites.

5. A process according to claim 1 wherein said extracting solvent comprises tetraethylene glycol.

6. A process according to claim 1 wherein said extracting solvent is a mixture of about 75 to about 99 wt % organic solvent and about 1 to about 25 wt % water.

7. A process according to claim 1 wherein aliphatic hydrocarbons are also stripped in step (B) by said steam, which steam is condensed to water, separated from said stripped aliphatic hydrocarbons, and passed to said anion exchange resin.

8. A process according to claim 7 wherein said stripped aliphatic hydrocarbons are returned to step (A).

9. A process according to claim 1 wherein aliphatic hydrocarbons from step (A) are washed with the water from step (G).

10. A process for reducing corrosion in a system in which $C_6$ to $C_8$ aromatic hydrocarbons are separated from a mixture with $C_6$ to $C_8$ aliphatic hydrocarbons comprising (A) extracting said aromatic hydrocarbons from said mixture with an extracting solvent that comprises a mixture of about 88 to about 92 wt % tetraethylene glycol and about 8 to about 12 wt % water;

(B) stripping said extracted a romatic hydrocarbons from said extracting solvent with steam;

(C) condensing said steam to form water;

(D) separating said water from said aromatic hydrocarbons;

(E) passing all of said separated water from step (D) through a basic anionic exchange resin loaded with hydroxyl ions;

(F) heating said separated water to produce said steam;

(G) washing said aromatic hydrocarbons from step (D) with distilled water and (H) recycling said distilled water in a loop that includes a distillation step and step (G), and recycling the water in steps (B), (C), (D), (E), and (F) in a separate and independent loop.

11. A process according to claim 10 wherein aliphatic hydrocarbons are also stripped in step (B) by said steam, which steam is condensed to water, separated from said stripped aliphatic hydrocarbons, and passed to said anion exchange resin.

12. A process according to claim 11 wherein said stripped aliphatic hydrocarbons are returned to step (A).

13. A process according to claim 12 wherein aliphatic hydrocarbons from step (A) are washed with the water from step (G).

14. A process according to claim 10 wherein said basic anionic exchange resin is macroreticular.

15. A process for reducing corrosion in a system in which $C_4$ to $C_{12}$ aromatic hydrocarbons are separated from a mixture with $C_4$ to $C_{12}$ aliphatic hydrocarbons comprising (A) extracting said aromatic hydrocarbons from said mixture with said $C_4$ to $C_{12}$ aliphatic hydrocarbons using an extracting solvent that comprises about 75 to about 99 wt % polar organic solvent and about 1 to about 25 wt % water;

(B) stripping said extracted aromatic hydrocarbons from said polar organic solvent with steam;

(C) condensing said steam to form water;

(D) separating said water from said aromatic hydrocarbons;

(E) passing all of said separated water from step (D) through a basic anionic exchange resin;

(F) heating said water to produce said steam;

(G) washing said aromatic hydrocarbons from step (D) with distilled water;

(H) washing said aliphatic hydrocarbons from step (A) with water from step (G) to form a solvent-water mixture;

(I) distilling said solvent-water mixture to form said extracting solvent and distilled water used in step (G), whereby said distilled water in steps (G), (H), and (I) is recycled in a loop; and (J) recycling the water in steps (B), (C), (D), (E), and (F) in a loop that is separate and independent from the loon formed by steps (G), (H) and (I).

16. A process according to claim 15, wherein aliphatic hydrocarbons are also stripped in step (B) by said steam, which steam is condensed to water which is passed to said anion exchange resin.

17. A process according to claim 16 where said stripped aliphatic hydrocarbons are returned to step (A).

18. A process according to claim 15 wherein said basic anion exchange resin is a strong base resin.

19. A process according to claim 18 wherein said basic anion exchange resin is loaded with hydroxyl ions.

20. A process according to claim 18 wherein said basic anion exchange resin has tertiary amine active sites.

21. A process according to claim 15 wherein said polar organic solvent is tetraethylene glycol.

22. A process according to claim 15 wherein said extracting solvent is a mixture of about 88 to about 92 wt % polar organic solvent and about 8 to about 12 wt % water.

* * * * *